US007997086B2

(12) United States Patent
Dorsey

(10) Patent No.: US 7,997,086 B2
(45) Date of Patent: Aug. 16, 2011

(54) REFRIGERATED ODOR REDUCING TRASH RECEPTACLE

(76) Inventor: Clay Robinson Dorsey, Birmingham, AL (US)

( * ) Notice: Subject to any disclaimer, the term of this patent is extended or adjusted under 35 U.S.C. 154(b) by 423 days.

(21) Appl. No.: 12/150,166

(22) Filed: May 20, 2008

(65) Prior Publication Data

US 2008/0264069 A1 Oct. 30, 2008

(51) Int. Cl.
*F25B 21/02* (2006.01)

(52) U.S. Cl. ..... 62/3.6; 62/3.7

(58) Field of Classification Search ..... 62/3.6, 62/3.2, 3.62, 3.7, 156, 129; 220/592.2
See application file for complete search history.

(56) References Cited

U.S. PATENT DOCUMENTS 6,676,757 B2 * 1/2004 Kitano et al. ..... 118/676
2003/0108460 A1 * 6/2003 Andreev et al. ..... 422/186.07
2004/0250813 A1 * 12/2004 Post et al. ..... 128/203.12

* cited by examiner

*Primary Examiner* — Mohammad Ali
(74) *Attorney, Agent, or Firm* — Jones, Walker, Waechter, Poitevent, Carrere & Denegre, LLP

(57) ABSTRACT

This trash cooling unit system includes a Thermoelectric cooling system (TEC) which requires no harmful Freon or refrigerant liquids. It has a temperature controller to maintain a constant temperature. This system will operate on DC 24V at 12 Amps and move up to 40 watts of heat. Also, it has an AC adapter. The capacity of the trash unit is: width: approx. 10½," Depth: approx. 9½," Height: approx. 22". The interior enclosure has a temperature of about 45° F. in a 80° F., 80% relative humidity ambient. This corresponds to approximately 17 watts of passive heat load from air convection and conduction through 2" of Polystyrene which prevents any condensation.

15 Claims, 3 Drawing Sheets

REFRIGERATED ODOR REDUCING TRASH RECEPTACLE

CROSS REFERENCE TO RELATED APPLICATIONS

This application claims priority to provisional application No. 60/926,312 filed on Apr. 26, 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Not Applicable

BRIEF SUMMARY OF THE INVENTION

This unique trash cooling system is designed to reduce bacterial odor-causing airborne agents that can infuse the kitchen space with unpleasant food/trash odors. This mechanism enables individuals to discard unwanted foods such as meats, poultry, and fish or remnants thereof such as bones, uncooked fatty carvings of meats/poultry or spoilage of fruits, vegetables, and dairy products without the putrid odors diffusing throughout the entire kitchen area. Most importantly, during holidays this odor-reducing system allows trash to be securely stored in a cooled environment until retrieval occurs from the local city/county waste and sanitation department. In addition, an air filter has been designed under the top lid that can be filled with filtrated bags of baking soda or charcoal.

By maintaining a cool and microbial reducing environment of about 45° F. for trash impaction, benefits for the environment will increase tremendously. The benefits of this system can perhaps reduce air pollution via outdoor trash incinerations, decrease outdoor communal infestation of gnats, flies, and rodents and will possibly increase a positive awareness of improving our environment by practicing safe, innovative sanitation methods.

DETAILED DESCRIPTION OF THE INVENTION

Figure 1:
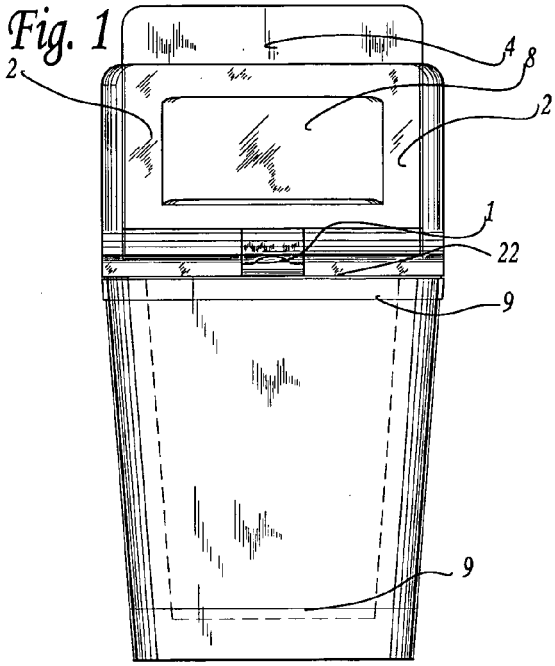
FIG. 1 Shows the Front View
FIG. 2 Shows the Right and Left Side Views
FIG. 3 Shows the Rear View
FIG. 4 Shows the Front View with the Top Lid Open
FIG. 5 Shows the Top View
FIG. 6 Shows the Exterior Top Cap View of the Filter
FIG. 7 Shows the Side View of the Filter Housing and the Cap with the Cap Position Opened
FIG. 8 Shows the Side View and Section View of the Filter Housing and the Cap with the Cap Position Opened
FIG. 9 Top and Bottom View of the Paper Filter bag
FIG. 10 Side View of the Paper Filter bag FIG. 11 Shows a Section Cut Away looking from the Side View
FIG. 12 Enlarged View of FIG. 11

Referencing FIG. 1. The lid (2) is recessed into the housing when the lid is closed. The latch (1) has a spring action release for opening and closing. The joint seam (22) is the break in the material. I have provided a top and bottom accent line (9) for aesthetics.

Figure 2:
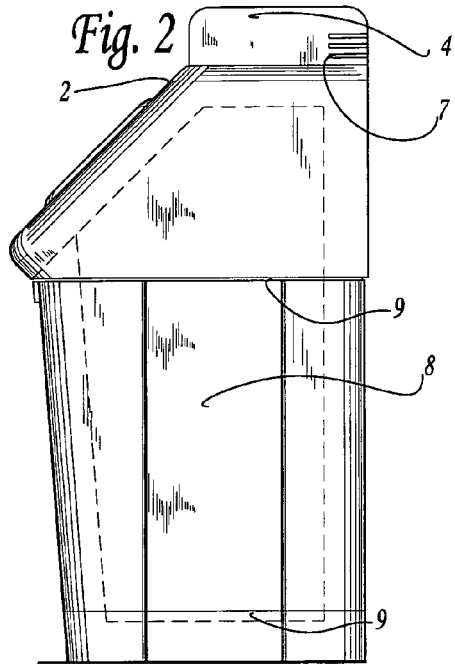

Referencing FIG. 2. The housing (4) projects about 2½ inches which houses the Thermoelectric cooling system (TEC). The raised area (8) is about ¼" thick for aesthetics. Air vents (7) on the right and left side of Thermoelectric cooling system unit ventilation. Top and bottom accent lines (9) for aesthetics.

Figure 3:
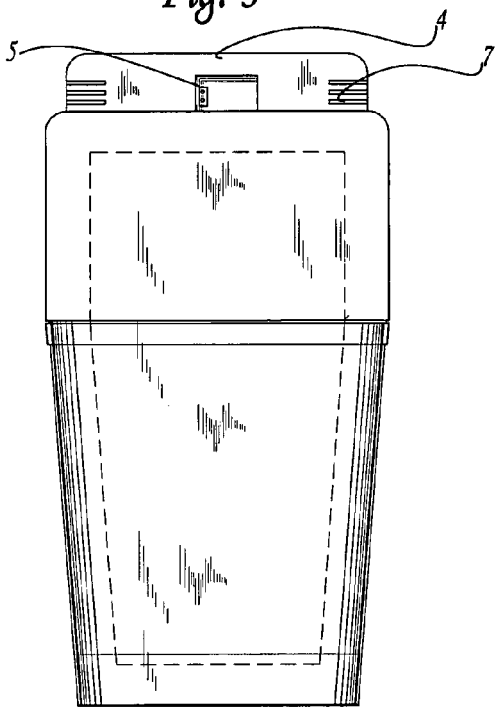

Referencing FIG. 3. I have provided air vents (7) on the right and left sides for the TEC unit ventilation. (5) indicate the jack input. Air vents (7) on the right and left side of Thermoelectric cooling system unit for ventilation on housing (4).

Figure 4:
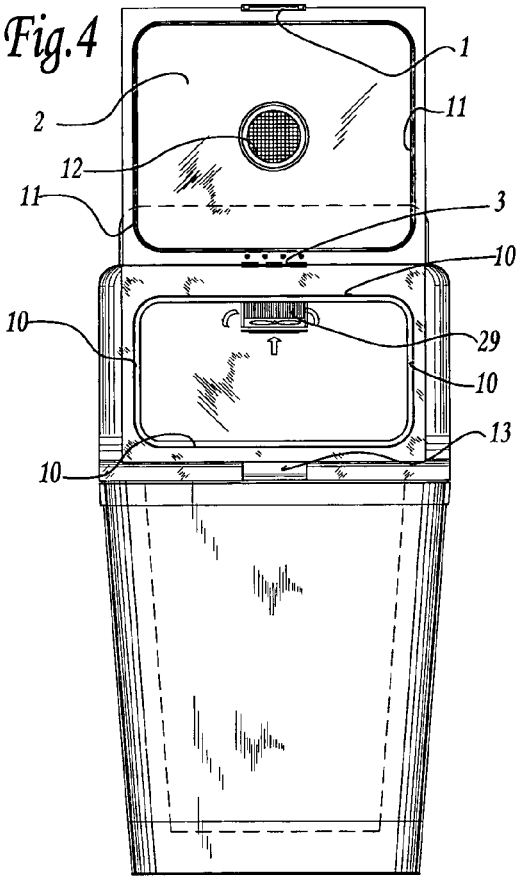

Referencing FIG. 4. I have provided a filter housing (12) that is an integral part of the lid (2). Also, there is a recessed Neoprene ⅛" thick by ¼" deep seal (11) at the perimeter of the lid (2). At the perimeter of the opening, there is a ¼" height ridge (10) that serves as an air seal to keep cool air in and warm air out when the lid (2) is closed. I have provided a recessed notch (13) for the latch (1). The hinge (3) sets in a recess notch in the housing.

Figure 5:
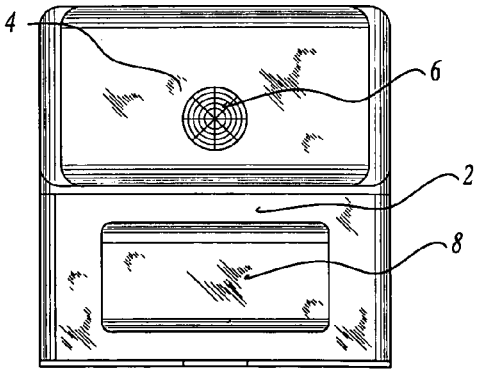

Referencing FIG. 5. I have provide a finger guard (6) which is an integral part of the housing (4) over the fan area. The lid (2) is in the closed position with the raised accent (8) above.

Figure 6:
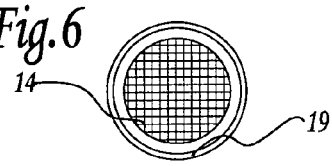

Referencing FIG. 6. The plastic mesh (14) is an integral part of the plastic filter housing (19).

Figure 7:
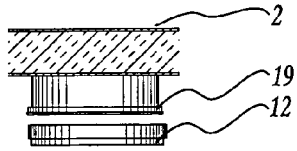

Referencing FIG. 7. The filter housing (19) is an integral part of the lid (2). The plastic cap (12) of the filter housing snaps on and off.

Figure 8:
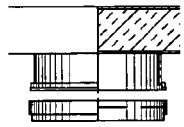

Referencing FIG. 8. The corrugated perimeter (15) seals in the baking soda or charcoal.

Figure 9:
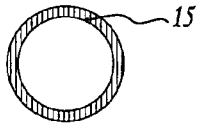

Referencing FIG. 9. This is a side view of the corrugated perimeter (15) that seals in the baking soda or charcoal.

Figure 10:
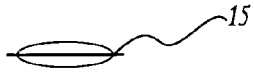

Referencing FIG. 10. Top view of the filter with the corrugated perimeter.

Figure 11:
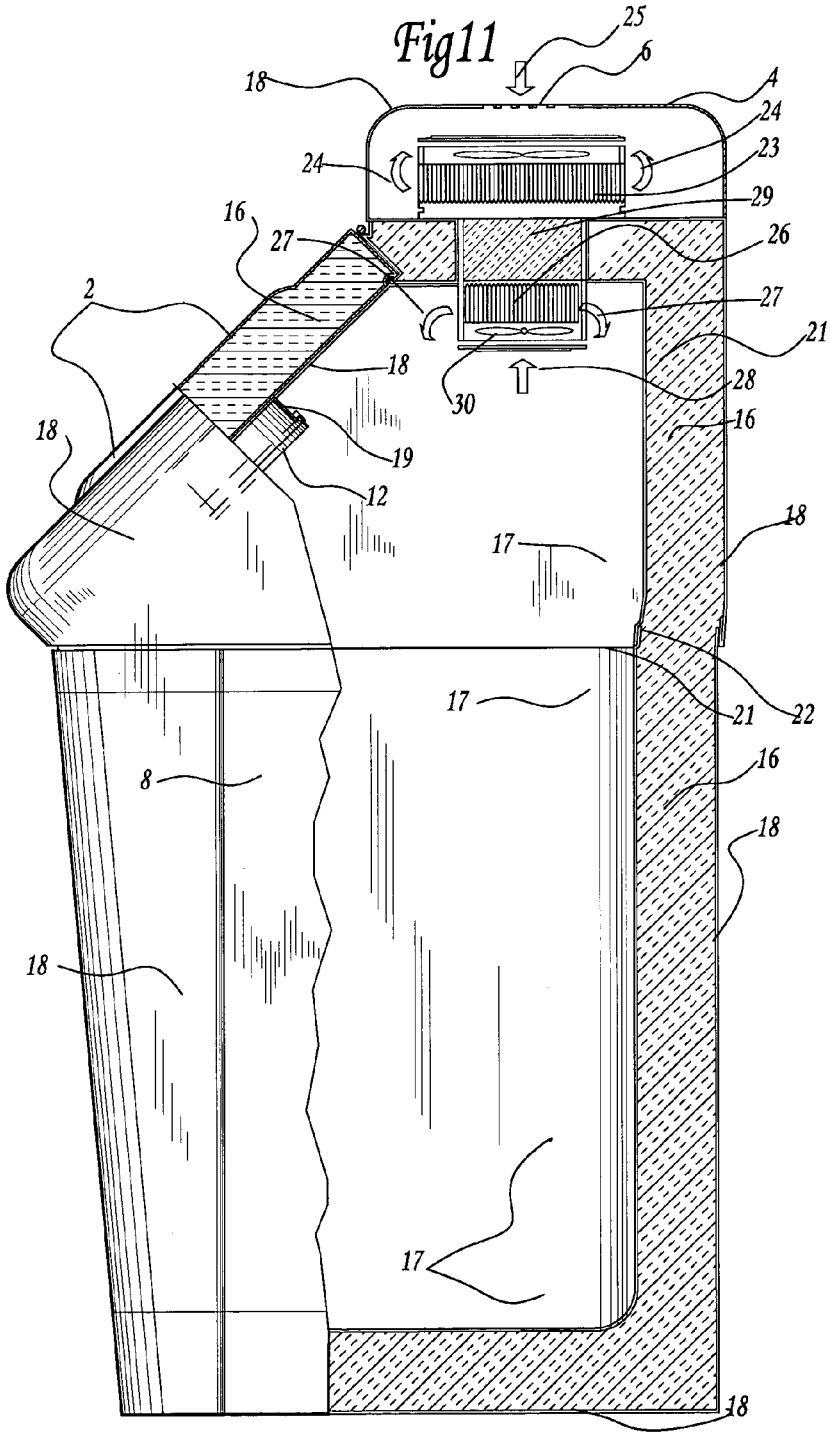

Referencing FIG. 11. The Thermoelectric Unit operates on DC 24V at 12 Amps and moving up to 40 watts of heat. The cooling temperature for the interior is 45° F. The air cooling unit has a hot sink (23) which releases the hot air exhaust (24).

The ambient air (25) comes in through the finger guard (6). The cold sink (26) is located in the interior which releases cold air exhaust (27). The hot sink (23) and the cold sink (26) are separated by the thermoelectric cooler (29). The air (28) returns back by the fan (30). The finger guard (6) is made of a durable plastic (18) and is an integral part of the housing (4). The outside material of the entire unit is durable plastic (18). The insulation (16) is 2 inch extruded Polystyrene which prevents any condensation. The interior (17) lining consists of a durable plastic. The joint seam (22) consists of a interlocking cleat (21). This joint seam is provided to tie the materials together. Also, the filter housing (19) with a snap on cap (12) is an integral part of the lid (2).

Figure 12:
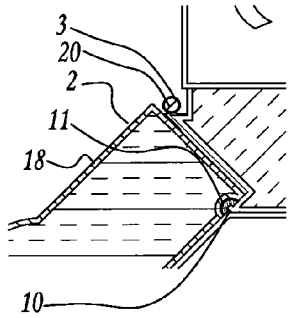

Referencing FIG. 12. The hinge (3) is attached to the backside of the lid (2). The lid (2) opens and closes with pivoting screws opposite each other (20). When the lid is closed, the ridge (10) and Neoprene (11) keep cool air in.

SEQUENCE LISTING

Not Applicable

What is claimed:

1. A Refrigerated Odor Reducing Trash Receptacle comprising:

a. an interior storage enclosure to store garbage material;

b. an outer housing, the outer housing enclosing said interior storage enclosure and a raised exterior enclosure disposed above the interior enclosure;

c. an insulation d. a Thermoelectric cooling system comprising i. a hot sink comprising a first fan that circulates hot air exhaust, wherein said hot sink is positioned in the exterior enclosure, and ii. a cold sink comprising a second fan that circulates cold air exhaust within said interior storage enclosure;

e. an air filter;

f. a temperature controller; and g. a sloped lid hingedly connected to the outer housing.

2. The receptacle of claim 1, wherein said thermoelectric cooling system is capable of maintaining a temperature of approximately 45 degrees Fahrenheit in an 80 degrees Fahrenheit and 80 percent relative humidity ambient environment.

3. The receptacle of claim 1, wherein said thermoelectric cooling system operates on DC 24V at 12 Amps.

4. The receptacle of claim 1, further comprising air filter housing, wherein a cap is removably connected to said air filter housing.

5. The receptacle of claim 1, wherein said lid further comprises a sealant at a perimeter of said lid.

6. The receptacle of claim 5, wherein said sealant is neoprene.

7. The receptacle of claim 1, wherein said outer housing comprises plastic.

8. The receptacle of claim 1, wherein said insulation comprises polystyrene.

9. The receptacle of claim 1, further comprising an inner lining interior to said insulation, wherein said inner lining comprises plastic.

10. The receptacle of claim 1, wherein said air filter comprises at least one member of the group consisting of charcoal and baking soda.

11. A Refrigerated Odor Reducing Trash Receptacle comprising:

a. an interior storage enclosure to store garbage material;

b. an outer housing, the outer housing enclosing said interior storage enclosure and a raised exterior enclosure disposed above the interior enclosure;

c. an insulation;

d. an inner lining interior to said insulation, wherein said inner lining comprises plastic;

e. a thermoelectric cooling system that operates on DC 24V at 12 Amps capable of moving 40 watts of heat and capable of maintaining a temperature of approximately 45 degrees Fahrenheit in an 80 degrees Fahrenheit and 80 percent relative humidity ambient environment, wherein said thermoelectric cooling system comprises:

i. a hot sink comprising a first fan that circulates hot air exhaust, wherein said hot sink is positioned in the exterior enclosure, and ii. a cold sink comprising a second fan that circulates cold air exhaust within said interior storage enclosure;

f. an air filter housed in an air filter housing;

g. a temperature controller; and h. a sloped lid comprising a sealant around a perimeter of said lid, wherein said lid is hingedly connected to said outer housing.

12. The receptacle of claim 11, wherein said air filter further comprises at least one member of the group consisting of charcoal and baking soda.

13. The receptacle of claim 12, wherein a cap is removably connected to said air filter housing.

14. The receptacle of claim 12, wherein said sealant around said perimeter of said lid comprises neoprene.

15. The receptacle of claim 12, wherein said insulation comprises polystyrene.

* * * * *